US006877997B2

(12) United States Patent
Schäty

(10) Patent No.: US 6,877,997 B2
(45) Date of Patent: Apr. 12, 2005

(54) ELECTRICAL CAPPED CONTACT STUD AND METHOD OF FASTENING AN ELECTRICAL CONTACT

(75) Inventor: Harald Schäty, Wetzlar (DE)

(73) Assignee: Newfrey LLC, Newark, DE (US)

( * ) Notice: Subject to any disclaimer, the term of this patent is extended or adjusted under 35 U.S.C. 154(b) by 60 days.

(21) Appl. No.: 10/612,433

(22) Filed: Jul. 2, 2003

(65) Prior Publication Data

US 2004/0062622 A1 Apr. 1, 2004

Related U.S. Application Data

(63) Continuation of application No. PCT/GB02/00080, filed on Jan. 10, 2002.

(30) Foreign Application Priority Data

Jan. 10, 2001 (DE) ..... 101 00 832
Aug. 14, 2001 (DE) ..... 101 38 800

(51) Int. Cl.[7] ..... H01R 4/66
(52) U.S. Cl. ..... 439/92
(58) Field of Search ..... 439/92, 86; 411/429, 411/430, 431

(56) References Cited

U.S. PATENT DOCUMENTS

| | | | | |
|---|---|---|---|---|
| 3,030,997 A | | 4/1962 | Collins | |
| 4,013,110 A | * | 3/1977 | Darling | 411/307 |
| 4,666,190 A | * | 5/1987 | Yamabe et al. | 285/93 |
| 4,883,399 A | * | 11/1989 | MacLean | 411/431 |
| 5,075,176 A | * | 12/1991 | Brinkmann | 428/647 |
| 5,207,588 A | | 5/1993 | Ladouceur et al. | |
| 5,442,133 A | * | 8/1995 | Arnold et al. | 174/51 |
| 5,590,992 A | * | 1/1997 | Russell | 411/431 |
| 5,644,830 A | * | 7/1997 | Ladouceur et al. | 29/432.2 |
| 5,791,848 A | * | 8/1998 | Lanham | 411/373 |
| 5,944,465 A | * | 8/1999 | Janitzki | 411/310 |

FOREIGN PATENT DOCUMENTS

| | | |
|---|---|---|
| DE | 197 41 830 A1 | 3/1999 |
| DE | 197 41 830 A1 | 6/2003 |
| EP | 0 640 404 A1 | 3/1995 |
| EP | 0 641 944 A1 | 3/1995 |
| EP | 0 640 404 A1 | 6/2003 |

OTHER PUBLICATIONS

PCT International Search Report, PCT/GB02/00080, 4 pages.

* cited by examiner

*Primary Examiner*—Ross Gushi
(74) *Attorney, Agent, or Firm*—Harness, Dickey & Pierce, P.L.C.

(57) ABSTRACT

An electrical contact stud (1), a cap nut (12) of plastic material, an electrical contact system for fastening an electrical contact and a method for fastening an electrical contact to a workpiece (11) to be painted are provided. A cap nut (12), economically produced, made of plastics material, and not necessarily having to be electrically conducting, fastens an electrical contact shoe (21). As a plastics material nut can be self-locking, the required maximum torques for producing contact are relatively small, for example 8 Nm, and fastening an electrical contact is made possible even with thin sheets of metal with sheet metal thicknesses of less than 0.6 mm without deformation. The cap nut (12) made of plastics material serves in a first step as a seal against paint penetration into the electrical contact region and in a second step for fastening a contact shoe (21).

43 Claims, 3 Drawing Sheets

Fig.1
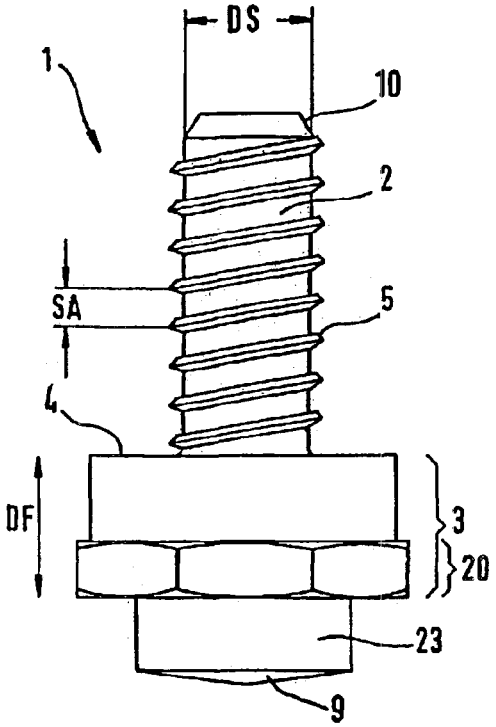
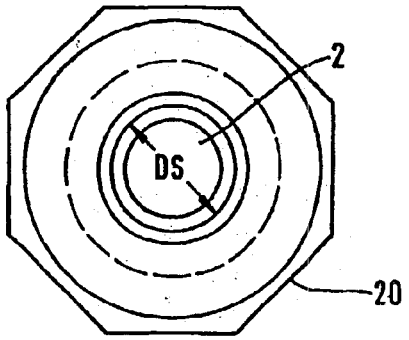
Fig.2
Fig.3
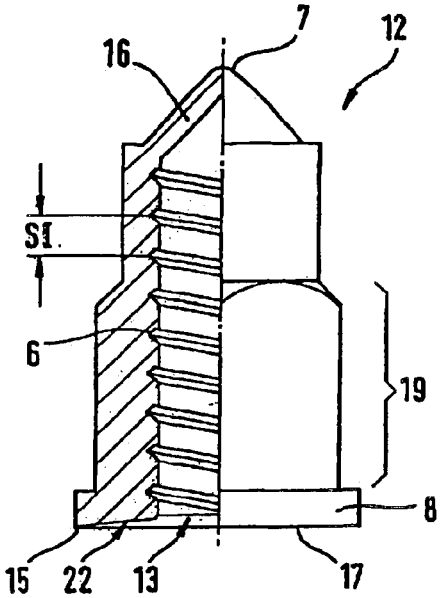
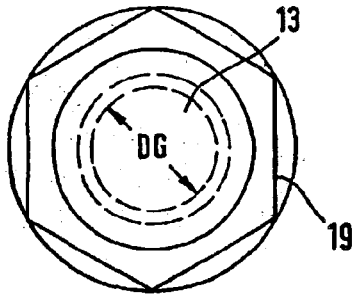
Fig.4

ELECTRICAL CAPPED CONTACT STUD AND METHOD OF FASTENING AN ELECTRICAL CONTACT

CROSS-REFERENCE TO RELATED APPLICATIONS

This application is a Continuation of International Application No. PCT/GB02/00080, filed Jan. 10, 2002, claiming priority to German patent application 101 00 832.5, filed Jan. 10, 2001, claiming priority to German patent application 101 38 800.4, filed Aug. 14, 2001. The disclosure of the above applications are incorporated herein by reference.

FIELD OF THE INVENTION

The invention relates to an electrical contact stud, in particular for fastening an electrical earth contact, with a shank, having an external thread, and an adjoining contact flange with a contact face facing the shank; a cap nut for electrical contact studs; an electrical contact system, in particular for fastening an electrical earth contact; and a method for fastening an electrical contact to a workpiece to be painted.

BACKGROUND OF THE INVENTION

A typical case of application for this is in automotive construction, where threaded studs, which can be welded on, soldered on or riveted, are used as electrical contact studs for fastening an electrical contact.

From EP 0 640 404 A1 a method is known, by which an electrical contact between a contact shoe and a sheet of metal to be painted is produced with the aid of a threaded stud and a cap nut. The cap nut is herein used in two ways. On the one hand the cap nut protects the threaded stud from being coated with paint during the painting process and on the other hand with the aid of the cap nut a contact shoe is fastened to the threaded stud. The advantage of this method, which uses metal cap nuts, is that by using the cap nut both as covering cap and as fastening element unnecessary waste in the form of covering caps covered with paint is avoided, as described in the prior art, for example of EP 0 243 078 B1.

A disadvantage of the known method is that the cap nut is a relatively expensive component if it is made of metal and that it has to be tightened with a large torque against the contact shoe, so that it does not come loose. However, large torques or large forces present a problem with mechanically sensitive workpieces, such as, for example thin sheets of metal, as they can cause deformations or damage to the workpiece when the nut is tightened.

It is therefore the object of the present invention to create economically an electrical contact stud, a cap nut, an electrical contact system and a method for fastening an electrical contact, whereby electrical contacts can be fastened to particularly sensitive workpieces, for example thin sheets of metal.

SUMMARY OF THE INVENTION

This object is achieved according to the invention by an electrical contact stud with the features according to claim 1 by a cap nut with the features according to claim 8, by an electrical contact system with the features according to claim 17 and by a method with the features of claim 20. Particular features and advantageous configurations, which can occur individually or in combination, are the subject of the respective dependent claims.

A substantial idea of the invention, which has an effect in all the components of the system, is the use of a cap nut made of a plastics material for fastening an electrical contact, which has so far not been considered owing to the electrically insulating property of most plastics materials. Tests have, though, surprisingly shown that the transition resistance of the system according to the invention is only minimally greater than that of completely metal systems, and in fact irrespective of whether an electrically conductive or an electrically insulating plastics material is chosen.

The electrical contact stud according to the invention, in particular for fastening an electrical earth contact with a shank which has an external thread and an adjoining contact flange with a contact face facing the shank is characterized in that the shank with the external thread is designed for screwing down a cap nut made of plastics material with a torque of at least 4 Nm, in particular at least 6 Nm, preferably approximately 8 Nm.

With the aid of the electrical contact stud a mechanical and electrical contact is produced on a workpiece, in particular on a sheet of metal. The contact stud can have a diameter between 4 and 10 mm, in particular between 6 and 8 mm. With the aid of the external thread on the shank a cap nut can be screwed down, with which the electrical contact, in particular an electrical contact shoe, is fastened. The electrical contact is produced between the contact shoe and the contact face facing the shank. The transition resistance mainly depends of these two surfaces, so the electrical properties of the cap nut do not matter.

According to the invention, for producing an electrical contact only comparatively low torques are required, so electrical contacts can be fastened even to very thin sheets of metal, in particular also on sheets of metal with thicknesses <0.6 mm, preferably <0.5 mm. With the aid of the contact flange the electrical contact stud is fastened over a wide area on a workpiece, in particular a sheet of metal. The larger torques customary with electrical contacts in the prior art serve mainly for securing against loosening of the nut, which can be achieved with plastics material nuts by constructive measures for achieving self-locking without torques of this kind. Basically, however, comparably large torques as with metal nuts can also be applied with cap nuts according to the invention, if this is required or desired. The contact flange thus has on the one hand the purpose of achieving adequate mechanical strength of the contact stud on the workpiece and on the other hand the purpose of making available a sufficiently large contact area for an electrical contact.

In one configuration of the invention the ratio of the inclination of the external thread to the diameter of the shank is at least 1:5, in particular at least 1:4, preferably approximately 1:3. In comparison to electrical contact studs for metal cap nuts a ratio of this kind of the inclination of the external thread to the diameter of the shank is very much larger. Owing to a ratio of this kind the thread of a cap nut made of plastics material is prevented from being pulled out.

In an advantageous configuration of the invention, the ratio of the thickness of the contact flange to the diameter of the shank is at least 1:2, in particular 1:1.5, and preferably approximately 1:1. By means of contact flanges of this kind of thickness, reliable gripping of the electrical contact stud by holding tongs is made possible. Lateral tilting is prevented. The good electrical contact between the electrical contact stud and the holding tongs necessary in a stud welding method with an arc is guaranteed.

In a particular configuration of the electrical contact stud according to the invention, the contact flange has on its side opposite the contact face a welding portion, preferably with a blunt conical projection. With the aid of the welding portion a welding connection is produced between the contact flange and a workpiece, in particular a sheet of metal. With the aid of the conical projection igniting a defined arc is made possible during the stud welding process. These parts are no different from those in customary earth studs for welding, as known in the prior art.

In an advantageous configuration of the invention the contact flange has a customary tool engagement region. With the aid of the tool engagement region the electrical contact stud can be gripped by a tool and the cap nut screwed down, without the workpiece, to which the electrical contact stud is fastened, being under mechanical strain. In addition the tool engagement region can be used to tighten the cap nut if the electrical contact stud has not yet been fastened to the workpiece and the contact face of the electrical contact stud is to be protected by a cap nut.

In a special configuration of the electrical contact stud according to the invention the shank has a bezel on its open end. With the aid of the bezel on the one hand screwing down the cap nut is made easier and on the other hand the danger of damage by sharp edges is avoided.

In a particularly advantageous configuration of the invention the electrical contact stud is provided with a particularly corrosion-proof and electrically contact-conveying coating, in particular a tin-zinc alloy. By means of a coating of this kind, which can be applied, for example, by galvanizing, ageing processes of the contact faces, which could lead to an increase in the contact resistance and therefore to a reduced conductivity, are suppressed.

A cap nut according to the invention made of plastics material, in particular for fastening an electrical earth contact, with a cap and a front face, wherein the front face has a thread orifice containing an internal thread, is characterized in that the internal thread is designed in such a way and the material of the cap nut is of such a kind that the cap nut can be tightened on a corresponding external thread against a contact face with a torque of at least 4 Nm, in particular 6 Nm, preferably 8 Nm. The design and the material of the cap nut are chosen in such a way that torques of this kind can be absorbed. These torques are definitely in the range of torques normally used with metal cap nuts. However, plastics material nuts can be designed in such a way that self-locking against accidental loosening begins even with lower torques. As the electrical contact does not necessarily require large torques, the effect of torques or of forces on the workpiece can be reduced without the danger of loosening the nut. The torques used are nevertheless adequate to produce a good electrical contact between an electrical contact shoe and the contact face with the cap nut.

As the cap nut consists of plastics material, for its part it does not contribute to the electrical contact. It simply presses the contact shoe against the contact face. The pressure forces generated by the application of a torque on the cap nut are possibly smaller in comparison with metal cap nuts, but contrary to expectation are adequate for a good electrical contact. Metal cap nuts do not require a higher torque owing to the electrical resistance, but in order to effect self-locking of the cap nut. The high torques are not required for producing a smooth electrical contact and place unnecessary strain on the connection between contact stud and workpiece.

In an advantageous configuration of the cap nut according to the invention made of plastics material the ratio of the inclination of the internal thread to the diameter of the thread orifice is at least 1:5, in particular at least 1:4, preferably approximately 1:3. In order to guarantee adequate strength of the cap nut for the required torques and to prevent the internal thread being pulled out, ratios of this kind of the inclination of the internal thread to the diameter of the thread orifice are advantageous. By means of a ratio of this kind it is prevented that the cap nut is pulled out owing to excess stress. In general a larger ratio is advantageous for firmer plastics materials; a smaller ratio is necessary for softer plastics materials. With plastics material nuts, owing to the elasticity of the material, a ratio of this size is adequate to achieve self-locking.

If it is desired that the cap nut contributes to the electrical contact, according to the invention the cap nut is made of conductive plastics material. The plastics material of the cap nut can be provided with enclosed metal filaments which can be incorporated into the molding compound in a known manner during injection molding. The distribution of the metal filaments in the plastics material can be random. This configuration of the cap nut will provide, in comparison with a cap nut made of metal, a sufficient conductive cross-section for the subsequent use as earth terminal. A smaller dimension with which the cap nut can be screwed onto the stud produces a completely connected contact face between the internal screw thread of the cap nut and the external thread of the stud which contributes considerably to increasing the conductive cross-section. In addition to direct introduction of the electric current into the flange of the stud from the cable lug, the current can also flow into the cap nut and via the internal thread and the external thread into the threaded shank of the stud.

In a preferred configuration of the cap nut according to the invention the cap nut is made of a plastics material which can withstand particular mechanical strain, in particular of polyamide reinforced by glass fiber. The proportion of glass fiber in the plastics material is at least 10%, in particular at least 20%, preferably approximately 35% of the weight. Owing to the glass fibers a particular strength of the plastics material is achieved, which allows absorption of the necessary torques by the cap nut.

In an advantageous configuration of the cap nut according to the invention the cap has a centering point, as is known per se, as an assembly aid for components of this kind made of plastics material. With the aid of the centering point the cap nut can be centered during screwing down and the electrical contact stud, onto which the cap nut is screwed, can be centered during gripping for the placing process.

In a further advantageous configuration of the invention the front face of the cap nut has a sealing flange. With the aid of the sealing flange a particularly good seal against penetration of paint is achieved, so the electrical contact faces are protected from paint which could make the electrical contact heavier. According to the invention it is advantageous to design the front end with an obtuse-angled, conical recess, which forms outwardly a kind of sealing lip. With the aid of the sealing lip a particularly good seal against paint is produced. Alternatively, the sealing lip is formed by at least one bridge, which runs along the periphery of the sealing flange on the front end of the cap nut.

In a special configuration of the cap nut according to the invention the internal thread is formed with smaller dimensions. By means of the thus formed internal thread particularly good self-locking of the cap nut is generated, which makes independent loosening of the cap nut from an electrical contact stud more difficult or avoids it.

In a further special configuration of the cap nut according to the invention the cap has a tool engagement region. With the aid of the tool engagement region the cap nut is gripped by a tool and can be tightened. The tool engagement region can be provided in cross-section by a hexagon.

The electrical contact system according to the invention, in particular for fastening an electrical earth contact comprising an electrical contact stud, in particular an electrical contact stud according to the invention, and a cap nut made of plastics material, in particular a cap nut according to the invention, is characterized in that the electrical contact stud has a shank with an external thread and an adjoining contact flange and the cap nut has a front end with a thread orifice containing an internal thread, wherein the cap nut can be tightened with a torque of at least 4 Nm, in particular at least 6 Nm, preferably 8 Nm, against the contact flange.

The electrical contact system according to the invention allows fastening of an electrical contact to a workpiece with low transition resistance in spite of possibly comparatively low torques. The cap nut made of plastics material makes large torques, which are necessary, for example, with metal cap nuts, unnecessary. It is simultaneously capable of effecting adequately large pressing forces, which are necessary for constructing an electrical contact. With the aid of the electrical contact system the effects of forces or torques during fastening of the electrical contact onto the workpiece are reduced. This enables electrical contacts to be fastened even with thin sheets of metal with sheet metal thicknesses of less than 0.6 mm or even less than 0.5 mm. A plastics material nut with complex structure can therein be economically produced and has a lower weight than a metal nut.

In an advantageous configuration of the contact system according to the invention, to produce self-locking the inclination of the internal thread is different from the inclination of the external thread. Owing to the different inclinations the internal thread of the cap nut is elastically deformed, whereby friction forces between cap nut and electrical contact stud are reinforced. The incompatibility of the two thread inclinations effects further protection with respect to undesired loosening of the nut from the electrical contact stud.

In a further advantageous configuration of the electrical contact system according to the invention for producing self-locking the diameter of the thread on the shank is at least 2%, in particular at least 6%, preferably 8% larger than the diameter of the thread orifice. Owing to the difference in diameter the cap nut is braced on the electrical contact stud. In this way additional friction forces are generated for self-locking and a low transition resistance is achieved when the cap nut is made of conductive plastics material.

The method according to the invention for fastening an electrical contact to a workpiece to be painted using an electrical contact stud, in particular an electrical contact stud according to the invention, and a cap nut, in particular a cap nut according to the invention, comprises the following method steps: the cap nut is tightened on the contact stud with a torque of at least 1 Nm, a maximum of 4 Nm, and preferably approximately 3 Nm; the contact stud is fastened to the workpiece; paint is applied to the workpiece; the cap nut is loosened from the contact stud; an electrical contact shoe is placed in between the cap nut and the contact stud; the electrical contact shoe is pressed by tightening the cap nut with a torque of more than 4 Nm, preferably more than 6 Nm, in particular approximately 8 Nm.

The cap nut has on the one hand the function of protecting the contact stud from paint and on the other hand with it the mechanical and therefore the electrical contact is produced. The torques used are smaller by comparison with known methods, whereby application of the method can be carried out even with very thin sheets of metal.

The sequence of the steps of the method can be partially interchanged. In particular the electrical contact can first be fastened, whereupon the cap nut is tightened. In any case it is important that the cap nut is tightened to the contact stud before the paint is applied, so that the contact stud is protected from paint. With the aid of the method according to the invention electrical contacts are generated which are comparable in quality to the contacts produced with metal cap nuts. The respective electrical contact resistances coincide to within a few percent.

The contact stud can be fastened to the workpiece by welding, soldering or riveting. The cap nut made of plastics material can be tinted in a simple manner by a corresponding additive to the plastics material. The color can be enlisted for identifying the cap nut, in particular its task or its size.

In a particular configuration of the invention the cap nut is elastically or plastically deformed on first tightening. Owing to the elastic or plastic deformation a particularly good seal is achieved, whereby the electrical contact stud is particularly effectively protected from paint. By an elastic or plastic deformation, in particular during the second tightening, particularly good self-locking of the cap nut is further effected after final assembly.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Further advantageous configurations and characteristic features, which can occur individually or in combination, are described using the following drawings. The drawings are not, however, intended to restrict the invention, but are intended to depict the invention only as an example.

FIG. 1 shows a side view of an electrical contact stud according to the invention;

FIG. 2 shows a cross-section of an electrical contact stud according to FIG. 1;

FIG. 3 shows a side view, half cut open of a cap nut according to the invention;

FIG. 4 shows a cross-section of a cap nut according to FIG. 3;

DETAILED DESCRIPTION OF THE PREFERRED EMBODIMENTS

Figure 5:
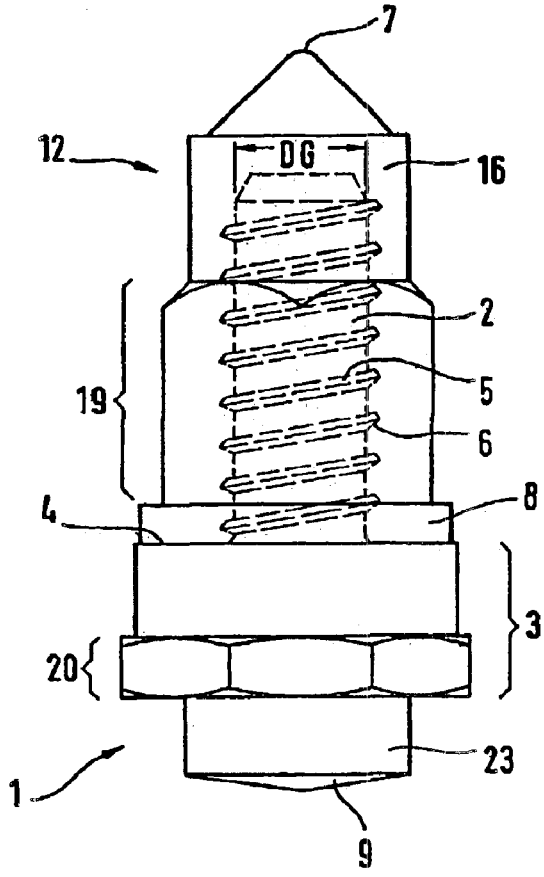
FIG. 5 shows a side view of an electrical contact system according to the invention.

The following description of the preferred embodiments is merely exemplary in nature and is in no way intended to limit the invention, its application, or uses.

FIG. 1 shows an electrical contact stud 1 according to the invention in side view with a shank 2, connected to a contact flange 3, wherein the contact flange 3 can be fastened to a workpiece 11 (not depicted) with the aid of a welding portion 23 and a conical projection 9. The contact flange 3 produces on one of its sides a mechanical contact with the workpiece and on the other side an electrical contact with a contact shoe 21 (not depicted) with the aid of its contact face 4. The shank 2 has an external thread 5, with which a cap nut 12 (not depicted) can be fastened. Contact studs 1 of this kind typically have a T6 external thread and are tightened with a torque of 6 to 8 Nm.

The ratio of the thickness DF of the contact flange to the diameter DS of the shank is approximately 1:1. This enables the electrical contact stud 1 to be gripped by a stud setting machine in a simple manner and an adequately good electrical contact to be achieved between stud setting machine and electrical contact stud during stud welding. The shank 2 has a bezel 10 on its open end. The ratio of the inclination SA of the external thread to the diameter DS of the shank 2 is 1:3. This large ratio is particularly suitable for screwing down cap nuts 12 made of plastics material. With the aid of the conical projection 9 an arc is generated during stud welding, starting from the point of the conical projection 9. The portion 23 is pressed into the liquid molten mass after the workpiece has been heated.

FIG. 2 shows the electrical contact stud 1 according to the invention according to FIG. 1 in cross-section. The shank 2 and the diameter DS of the shank 2 can be seen, as well as the tool engagement region 20 with which the electrical contact stud 1 can be gripped by a tool (not depicted).

FIG. 3 shows a cap nut 12 according to the invention with a thread orifice 13 containing an internal thread 6, wherein the ratio of the inclination SI of the internal thread 6 to the diameter DG of the thread orifice 13 is approximately 1:3. Cap nuts 12 of this kind typically have an M6 internal thread 6 and are tightened with approximately 9.6 Nm. The cap nut 12 has a tool engagement region 19, with which the cap nut 12 can be gripped by a tool (not depicted). In addition the cap nut 12 has a cap 16 with a centering point 7, with which the cap nut 12, and the electrical contact stud 1, onto which the cap nut 12 is screwed, can be gripped. A recess 22 on a sealing flange 8 of the cap nut 12 forms a sealing lip 15, with which a particularly efficient seal of the contact face 4 of the electrical contact stud 1 is effected.

FIG. 4 shows the cap nut 12 according to the invention according to FIG. 3 in cross-section with the thread orifice 13, the diameter DG of the thread orifice 13 and the tool engagement region 19.

The electrical contact system according to the invention is shown in FIG. 5 in side view. The cap nut 12 according to the invention made of plastics material can be seen with the centering point 17, the cap 16, the tool engagement region 19 and the sealing flange 8, as well as the electrical contact stud 1 according to the invention with the shank 2, the external thread 5, the contact face 4, the contact flange 3, which has a tool engagement region 20 and the welding portion 23 with the conical projection 9. The cap nut 12 is screwed onto the contact stud 1 and the contact face 4 is protected by the sealing flange 8.

Figure 6:
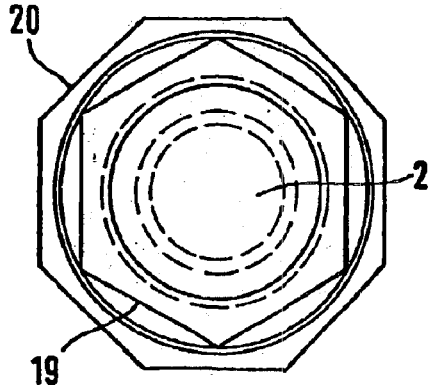
FIG. 6 shows a cross-section of an electrical contact system according to FIG. 5.

FIG. 6 shows the electrical contact system according to the invention according to FIG. 5 in cross-section with the tool engagement regions 19, 20 and the shank 2.

Figure 7:
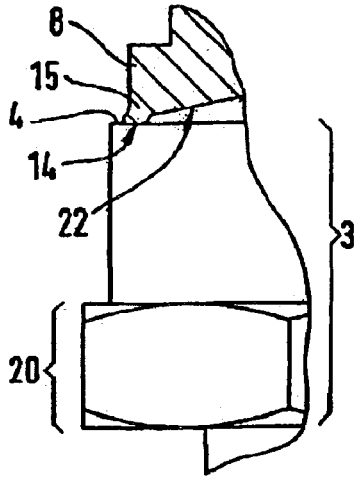
FIG. 7 shows a longitudinal section of a detail from the electrical contact system according to FIG. 5.

Protection of the contact face 4 from being covered with paint is shown in the detailed view of FIG. 7. The sealing flange 8, which has a sealing lip 15, produced by an obtuse-angled, conical recess 22, can be seen. The sealing lip 15 is pressed against the contact face 4, whereby a deformation 14 is caused. The deformation effects on the one hand a seal and on the other hand, owing to the elastic deformation of the cap nut 12, self-locking of the cap nut 12.

Figure 8:
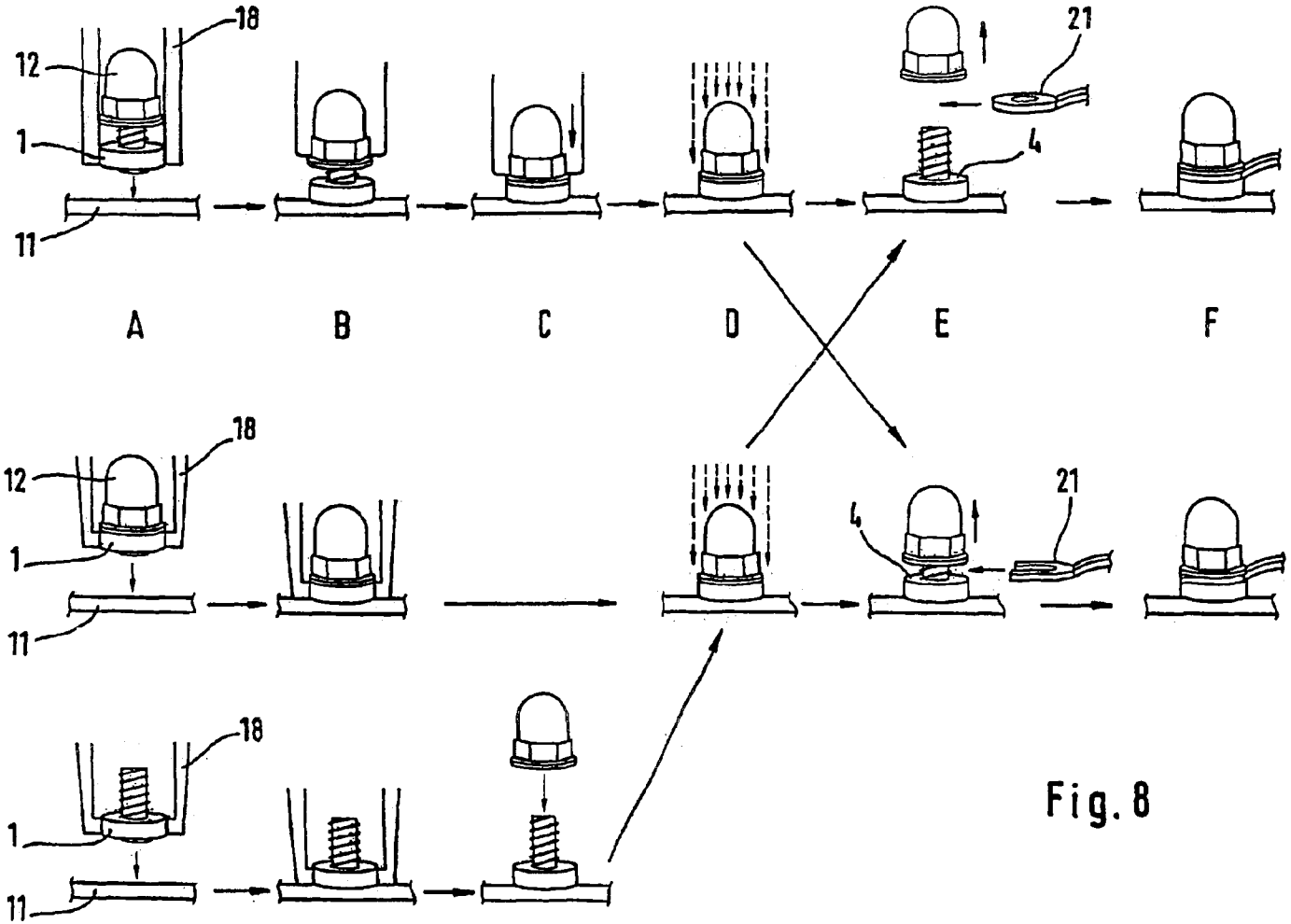
FIG. 8 shows various method sequences of the method according to the invention for fastening an electrical contact to a workpiece to be painted using an electrical contact stud and a cap nut.

FIG. 8 shows the method according to the invention for fastening an electrical contact to a workpiece 11 to be painted. The possible sequences are illustrated in the rows. In the top row the cap nut 12 is first partially screwed onto the electrical contact stud 1. Then the contact stud 1 is welded onto the workpiece 11, here designed as sheet metal. With the aid of the holding tongs 18 the electric current for welding is transferred onto the electrical contact stud 1. The cap nut 12 is subsequently firmly screwed onto the contact stud 1 for sealing. Then painting takes place. The cap nut 12 is subsequently loosened, so that an electrical contact shoe 21 can be inserted, which by pressing is finally electrically contacted with the contact face 4 with the aid of the cap nut 12.

In the second row the cap nut 12 is first firmly screwed onto the contact stud 1. The contact stud 1 is held by the holding tool 18 and fastened to the workpiece 11 by a welding process. Then painting takes place. The cap nut 12 is partially loosened and the contact shoe 21 is inserted. By tightening the cap nut 12 with a torque of for example. Approximately 8 Nm the contact shoe 21 is fastened and well contacted electrically with the contact face 4.

In the third line the contact stud 1 is held by the holding tool 18 and welded on. The cap nut 12 is subsequently screwed down. Then painting takes place. The contact shoe 21 is inserted in the described manner.

The invention relates to an electrical contact stud 1, a cap nut 12 made of plastics material, an electrical contact system for fastening an electrical contact, as well as a method for fastening an electrical contact to a workpiece 11 to be painted. The invention is characterized firstly in that the cap nut is made of plastics material and can therefore be produced economically. In addition the required maximum torques for generating the electrical and mechanical contact can be comparatively small, can be in particular 8 Nm, whereby fastening an electrical contact is made possible even with thin sheets of metal with sheet metal thicknesses of less than 0.5 mm without deformations.

What is claimed is:

1. An electrical contact stud for fastening an electrical earth contact, the stud comprising:

a shank having an external thread;

a contact flange adjoining the shank, having a contact face facing the shank; and a cap nut made of a conductive plastic material;

wherein the shank having the external thread is operable to screw down the cap nut with a torque of at least 4 Nm.

2. The electrical contact stud of claim 1, wherein the shank having the external thread is operable to screw down the cap nut with a torque of at least 6 Nm.

3. The electrical contact stud of claim 1, wherein the shank having the external thread is operable to screw down the cap nut with a torque of approximately 8 Nm.

4. The electrical contact stud according to claim 1, wherein a ratio of an inclination of the external thread to a diameter of the shank is at least 1:5.

5. The electrical contact stud according to claim 1, wherein a ratio of an inclination of the external thread to a diameter of the shank is at least 1:4.

6. The electrical contact stud according to claim 1, wherein a ratio of an inclination of the external thread to a diameter of the shank is approximately 1:3.

7. The electrical contact stud according to claim 1, wherein a ratio of a thickness of the contact flange to a diameter of the shank is at least 1:2.

8. The electrical contact stud according to claim 1, wherein a ratio of a thickness of the contact flange to a diameter of the shank is approximately 1:1.5.

9. The electrical contact stud according to claim 1, wherein a ratio of a thickness of the contact flange to a diameter of the shank is approximately 1:1.

10. The electrical contact stud according to claim 1, wherein the contact flange comprises a welding portion having a blunt conical projection, the welding portion positionable on a contact flange face opposite the contact face.

11. The electrical contact stud according to claim 1, wherein the contact flange of the stud comprises an axial extension forming a contact face for introduction of a welding current.

12. The electrical contact stud according to claim 1, wherein the contact flange comprises a tool engagement region.

13. The electrical contact stud according to claim 1, wherein the shank comprises a bezel on an open end.

14. The electrical contact stud according to claim 1, wherein the contact stud comprises a substantially corrosion-proof and electrically contact-conveying coating.

15. The electrical contact stud according to claim 14, wherein the coating comprises a tin-zinc alloy.

16. A cap nut for fastening an electrical earth contact, the cap nut comprising:

a conductive plastic cap having at least one embedded element; and a front end of the cap including a thread orifice containing an internal thread and a sealing flange;

wherein the internal thread of the cap nut is tightenable on a corresponding external thread of the electrical earth contact until the sealing flange engages against a contact face of the electrical earth contact with a torque of at least 4 Nm.

17. The cap nut of claim 16, wherein the internal thread of the cap nut is tightenable on the corresponding external thread, against the contact face, with a torque of approximately 6 Nm.

18. The cap nut of claim 16, wherein the internal thread of the cap nut is tightenable on the corresponding external thread, against the contact face, with a torque of approximately 8 Nm.

19. The cap nut according to claim 16, wherein a ratio of an inclination of the internal thread to a diameter of the thread orifice is at least 1:5.

20. The cap nut according to claim 16, wherein a ratio of an inclination of the internal thread to a diameter of the thread orifice is at least 1:4.

21. The cap nut according to claim 16, wherein a ratio of an inclination of the internal thread to a diameter of the thread orifice is approximately 1:3.

22. The cap nut according to claim 16, wherein the embedded element comprises a metal element.

23. The cap nut according to claim 22, wherein the metal element comprises metal filaments.

24. The cap nut according to claim 16, wherein the plastic material comprises a polyamide reinforceable by a plurality of glass fibers.

25. The cap nut according to claim 24, wherein the plastic material comprises at least 10% glass fibers.

26. The cap nut according to claim 24, wherein the plastic material comprises at least 20% glass fibers.

27. The cap nut according to claim 24, wherein the plastic material comprises approximately 35% glass fibers.

28. The cap nut according to claim 16, wherein the cap comprises a centering point.

29. The cap nut according to claim 16, wherein the sealing flange comprises a paint seal.

30. The cap nut according to claim 16, wherein a diameter of the sealing flange is one of equivalent to and less than a diameter of the contact face.

31. The cap nut according to claim 16, wherein the front end comprises one of a concave surface and an obtuse-angled, conical recess, operably forming a front end outside sealing lip.

32. The cap nut according to claim 16, wherein the internal thread comprises an internal thread dimension smaller than a corresponding external thread dimension.

33. The cap nut according to claim 16, wherein the cap comprises a tool engagement region.

34. An electrical contact system, comprising:

an automotive vehicle electrical ground;

an electrical contact stud of the automotive vehicle electrical ground, the contact stud having a shank;

the shank including an external thread;

a contact flange adjoining the shank, the contact flange having a contact face facing the shank; and a cap nut manufactured of a plastic, conductive material, the cap nut having a front end, the front end including a thread orifice containing an internal thread;

wherein the internal thread of the cap nut is tightenable on the external thread against the contact face using a torque of at least 4 Nm.

35. The electrical contact system of claim 34, wherein the torque is approximately 6 Nm.

36. The electrical contact system of claim 34, wherein the torque is approximately 8 Nm.

37. The electrical contact system of claim 34, wherein an inclination of the internal thread is different from an inclination of the external thread to produce a self-locking nut.

38. The electrical contact system of claim 34, wherein a diameter of the shank is at least 2% larger than a diameter of the thread orifice.

39. The electrical contact system of claim 34, wherein a diameter of the shank is at least 6% larger than a diameter of the thread orifice.

40. The electrical contact system of claim 34, wherein a diameter of the shank is approximately 8% larger than a diameter of the thread orifice.

41. A cap nut, comprising:

a plastic material having at least one embedded conductive element;

a first end extending to a centering point;

a second end operably forming a sealing flange;

a tool engagement region positioned between the first end and the second end, the tool engagement region having a hexagonal shape; and a threaded orifice coaxially aligned with the centering point, the threaded orifice opening through the second end, the threaded orifice having an internal thread.

42. The cap nut of claim 41, wherein the plastic material further comprises a color additive.

43. The cap nut of claim 41, comprising:

a sealing lip peripherally formed in the sealing flange; and an obtuse-angled conical recess operably forming the sealing lip.

* * * * *